US006271932B1

(12) United States Patent
Liedtke

(10) Patent No.: US 6,271,932 B1
(45) Date of Patent: Aug. 7, 2001

(54) LABELLING SYSTEM

(75) Inventor: Ulrich Liedtke, Vaduz (LI)

(73) Assignee: Floraprint International Establishment, Vaduz (LI)

( * ) Notice: Subject to any disclaimer, the term of this patent is extended or adjusted under 35 U.S.C. 154(b) by 0 days.

(21) Appl. No.: 09/125,352

(22) PCT Filed: Feb. 14, 1997

(86) PCT No.: PCT/EP97/00710

§ 371 Date: Oct. 14, 1998

§ 102(e) Date: Oct. 14, 1998

(87) PCT Pub. No.: WO97/29957

PCT Pub. Date: Aug. 21, 1997

(30) Foreign Application Priority Data

Feb. 14, 1996 (CH) ..... 375/96

(51) Int. Cl.[7] ..... B41B 15/00; B41J 15/00

(52) U.S. Cl. ..... 358/1.18; 358/1.17; 358/1.16; 358/1.13; 358/1.1

(58) Field of Search ..... 358/1.1, 1.8, 1.18, 358/1.12, 1.16, 1.17

(56) References Cited

U.S. PATENT DOCUMENTS 4,721,813 * 1/1988 Leinhos ..... 358/1.18
5,339,517 8/1994 Diemer .
5,621,864 * 4/1997 Benade et al. ..... 358/1.18

FOREIGN PATENT DOCUMENTS 9215978 5/1993 (DE) .

* cited by examiner

*Primary Examiner*—Edward Coles
*Assistant Examiner*—Twyler Lamb
(74) *Attorney, Agent, or Firm*—Birch, Stewart, Kolasch & Birch, LLP

(57) ABSTRACT

The present invention relates to a labelling system installable on a user's premises and comprising a product label having several fields, of which at least one is provided as a basic field (3) for holding basic information relating to the product to be labelled, at least one as a freely inscribable field (4) for holding variable information and at least one for holding an image which is directly related to the basic information a computer with a database having a first area (12) which in principle can be changed only by the system manufacturer or product manufacturer and in which product data relating to the product can be stored, and having a second area (15) which is also accessible to the user and in which specific user data relating to the product and the user can be stored, and with a printer (26) for the printing of labels (2) with the data mentioned an input unit for inputting the user data and controlling the computer and the printer (26), wherein the image data associated with software can also be stored in the first area (12) and wherein the software associates specific image data and a limited—optionally freely definable—selection of specific user data with the specific product data and makes it possible to print them out together on the printer, and wherein the label material or the material of the label sheet has the following specifications:

Color: initially colorless, white after laser-sensitizing coating

Thickness: 100 um

Surface resistance: $10^{12}$

Tensile Force:
Machine direction: MD 15.5 kg/mm$^2$
Diagonal: TD 17.5 kg/mm$^2$

Elongation at break:
MD 120%
TD 120%

Shrinkage:
MD 3%

(after 5 min at 190)
TD 2%.

2 Claims, 4 Drawing Sheets

LABELLING SYSTEM

This application is the national phase under 35 U.S.C. §371 of prior PCT International Application No. PCT/EP97/00710 which has an International filing date of Feb. 14, 1997 which designated the United States of America, the entire contents of which are hereby incorporated by reference.

BACKGROUND OF THE INVENTION

The invention relates to an improved labelling system for printing labels with information relating to the product to be labelled, in particular in the horticultural sector.

The purpose of labels is basically to inform the customers, for example, about the manufacturer of the product, universal and place-related trade names and product properties, the price, contraindications and the like—in other words standardized and varying information. It is important for the consumer that, in addition to the planting instructions, images of mature and flowering plants are also shown on the label and the customer information is thus optimized.

A known labelling system has been published in the Applicant's German Utility Model Application No. 9215978.8 a few years ago. For various reasons, however, it did not become established on the market. The essential disadvantage was that, owing to the separation between image data and specific text data, the flexibility for the user was not optimal. The users required to stock a certain quantity of labels printed with various images and having preprinted images and designations, for example (cf. page 4, paragraph 2, of the German Utility Model) in order to be able to print the desired information to be varied by the user in these labels to prepare usable labels from the prefabricated labels. With an average range of 2000–2500 different plants, for example on a plant dealer's premises, this meant an enormous administrative and stock-keeping effort. Further problems arose from software implications which had not been optimally solved.

Thus, in the case of the known label, for example, an unassociated text might be printed by an inexperienced person on a label preprinted with the image, since in fact the image was already preprinted.

SUMMARY OF THE INVENTION

It is therefore the object of the invention to provide an improved labelling system which makes it possible to print labels with information of different kinds directly on the user's premises, of which data of a first area (for example the name and/or the trade name of the manufacturer of the labelling system or of the products, another representation and/or the universal designation of the product) should be fixed or should be capable of being changed only by, for example, the manufacturer and of which other data of a second area (for example price, place- or user-related information) should be capable of being influenced by the user of the system, for example by a plant dealer, the required stock-keeping being reduced to virtually zero and the safety during printing being increased, in contrast to the known label.

DETAIL DESCRIPTION OF THE INVENTION

Figure 1:
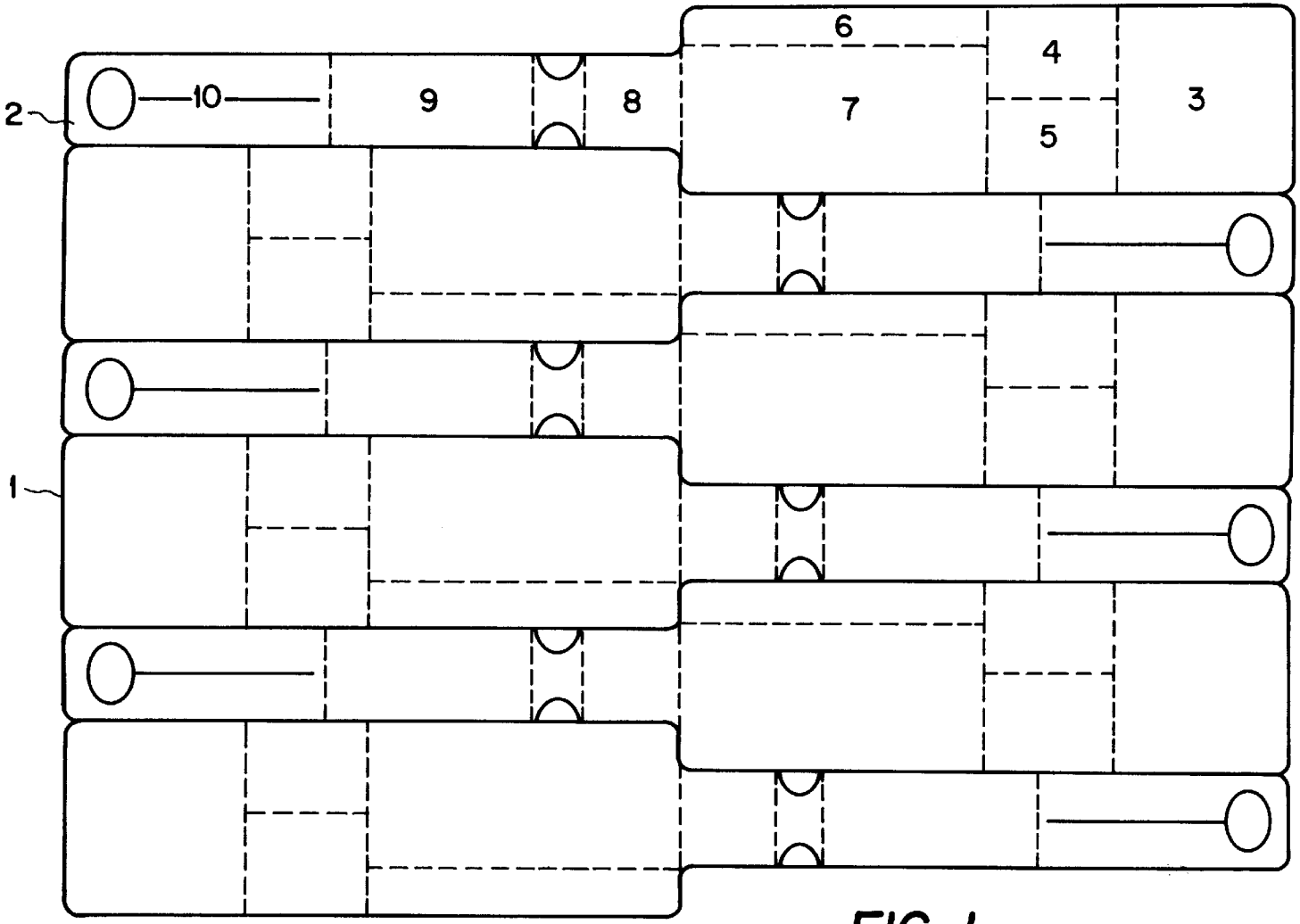
FIG. 1 shows a variant of a label sheet with a printed label as produced as a whole by the user.

This object is achieved, according to the invention, by the use of the features of claim 1 in combination. According to the invention, the system manufacturer thus provides the user with a complete system in which said user need only insert a raw label material (paper sheets or the like) and must input the desired data for the desired labels via the input unit, after which he obtains completely printed labels with the data from the first and from the second area.

The data of the first area are stored in a database which in principle is accessible only to the manufacturer of the labelling system for changes. On the other hand, a database in the second area contains data which are accessible in particular to the user and can be changed by the latter. These last-mentioned features also correspond to the labelling system according to the Utility Model Application mentioned. According to the invention, however, specific relationships of individual data fields within the first and within the second area, between one another and with corresponding data fields in the respective other area, are now included (cf. claim 1). As a result of this, the user, with a minimum of knowledge and with a minimum of process steps (input steps), is able to produce completely correct labels. Thus, a selection of different names for one and the same plant which are commonly used throughout Europe can be stored, for example, in a field of the second area. As soon as the user keys in one of these names familiar to him (optionally also only a part of this name known to him, provided that this part is significant for the name itself) in an input field of his input unit (keyboard and monitor), according to the invention the software automatically links this information with the only scientifically correct, generic name of the plant in the field of the generic names in the first area and simultaneously also with the only correct image in the image data field of the first area. According to the invention, the software is also capable of linking further botanical data from the field of botanical data of the first or optionally also the second area with the first-mentioned data. If different botanical data are possible, the software can force the user to select, via the input unit, one of the possible botanical data (which may differ from region to region), after which said datum is always linked with the first-mentioned data by the software—preferably also in subsequent selection procedures.

According to a further development of the invention, the software may also be designed so that it is possible to make a certain selection from a quantity of prescribed information or to retrieve a section from prescribed information. For example, it might be possible to print an image section of a stored image, with the result that the customer can achieve a more individual setup with respect to his public.

The same process of data linkage is also envisaged for a field "company logo" or the like in the second area.

Moreover, a selection of possible prices which can preferably be defined beforehand by the user can be offered by the software for this complex structure of different data, from which selection the user makes a choice via the input unit or determines his own price.

According to the invention, the above-mentioned software-controlled linkages are preferably used in combination, but even partial combinations are protected according to the invention provided that at least two essentially different pieces of data from the fixed and/or the variable data storage areas are inevitably linked with one another by the software.

Preferred further developments of the labelling system according to the invention are the subject of the dependent claims or are described there. Further variants and specific embodiments of the invention are explained for a labelling system intended for plants, with reference to the attached drawings.

In general, plants cannot be provided with self-adhesive labels. So-called loop labels which can be fastened to a part of the plant, for example a stem or a branch, are therefore usually used.

FIG. 1 shows such a label as part of a sheet 1 comprising several labels separated from one another by perforations. Sheet 1 consists, for example, of weather-resistant paper or of a plastics sheet. A special embodiment of the sheet, according to the invention, comprises a polyester sheet which was treated by a special process. It is characterized by the following properties:

Colour: initially colourless, white after laser-sensitizing coating

Thickness: 100 $\mu$m

Surface resistance: $10^{12}$

Tensile force:

Machine direction: MD 15.5 kg/mm$^2$

Diagonal: TD 17.5 kg/mm$^2$

Elongation at break:

MD 120%

TD 120%

Shrinkage:

MD 3%

(after 5 min at 190°) TD 2%

The drying time after printing with printing ink or toner is not more than 3–5 seconds.

The weather resistance shows no change after a UV irradiation test in the QUV tester for 500 hours.

There is no detectable abrasion after 100 cycles (abrasivity CS-10) with a 1000 g weight.

The advantage of the special embodiment of the sheet, according to the invention, is that it can be printed without problems by means of printers (for example colour laser printers) and is nevertheless weather-resistant, so that the label can also be used in the open air. Moreover, the sheet is distinguished by sufficient tensile strength.

According to the invention, such a sheet is being used for the first time for loop labels printed in colour. To this extent, such a sheet may also advantageously be used independently of the other features of the invention.

The label 2 shown printed is divided into several fields, which however are merely by way of example. A basic field 3 contains a universal representation and/or universal name of the plant with a coloured image which is supplied to the printer from the area 1. In the case of plants, the botanical name is a possible universal name.

Examples of further fields are: a price field 4, a code field 5, a name field 6, a botanist's field 7, a reference number field 8, a store field 9 and a system printing field 10. Thus, according to national law, the dealer has the possibility of independently determining the price of the product within a certain range. The text in the price field must therefore be capable of being influenced by the dealer, i.e. by the user of the labelling system. The same applies to the code field 5 and in some cases to the name field 6 and the botany field 7. As already mentioned above, however, these field may, according to the invention, be related to one another by the software in such a way that misuse or errors due to incorrect inputs can be ruled out. Thus, plant names may differ from region to region or country to country: the height of growth of a plant and its position may vary from region to region. The user is preferably offered in each case a selection of preinput data in these fields so that he need not make random data manipulations but can make a selection based on his experience, for example by clicking with a mouse or the like. The store field 9 can be influenced by the user. The field 10 once again contains information which can be influenced only by the manufacturer or system supplier and is tailored to his needs.

Figure 4:
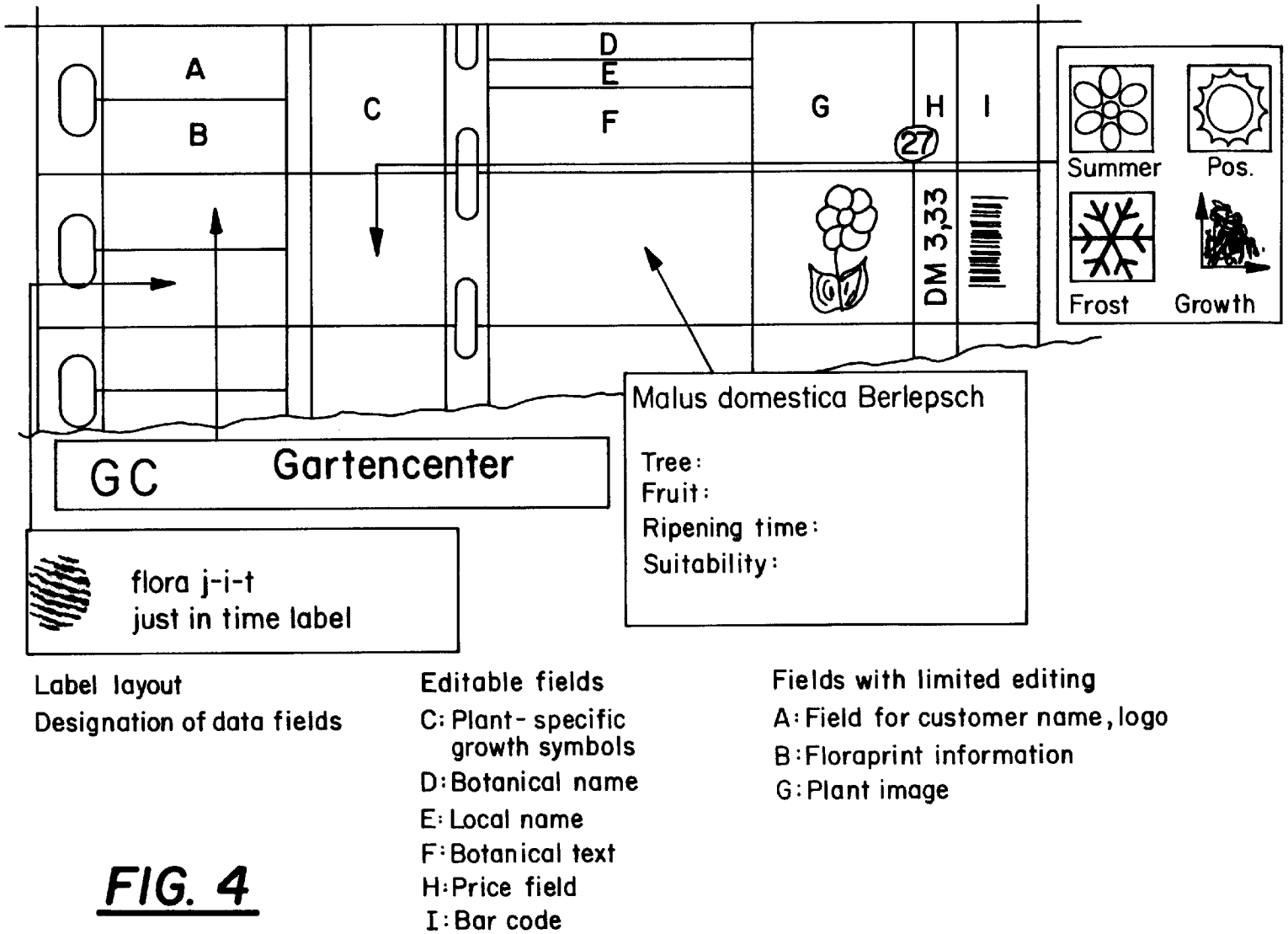
FIG. 4 shows a variant of a label sheet with an improved label.

FIG. 4, on the other hand, shows a label variant having a simplified geometric shape and—particularly preferably—having additional plant-specific growth symbols. The fields A–G have the following meaning:

A: Field for customer name, logo and address of the plant store

B: Floraprint information

C: Plant-specific growth symbols which, according to the invention, can be chosen from a varied symbol database so that regional differences can be taken into account. In certain circumstances, the user may also be able to influence the fixed master data here as an exception through appropriately adapted software.

D: Botanical name

E: Common name

F: Description of plant, growth information, botanical text

G: Plant image

H: Price field

I: Bar code field

What is novel and preferred is that a perforation is provided in the area between the field G and H and enables the user to separate the field H and I, for example at the checkout, in order to be able to produce the invoice by means of a bar code reader or to be able to key the price manually into the cash register. For the user's customers, this novel label has the advantage that he can leave the label without problems on the plant and is not inconvenienced by having to present it to the sales personnel to permit the price to be read.

Figure 3:
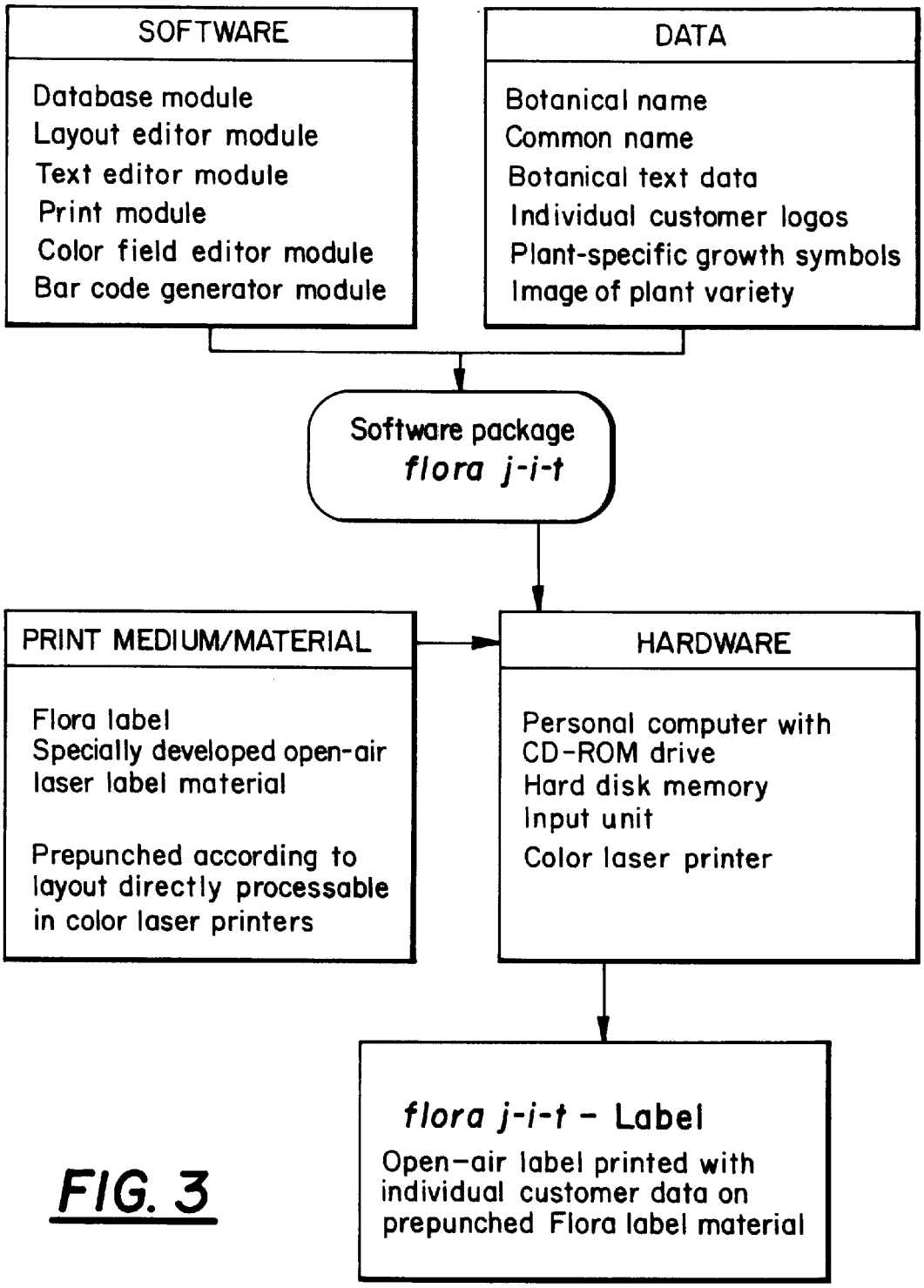
FIG. 3 shows a schematic organigram of the labelling system according to the invention.

FIG. 3 shows a scheme indicating the relationships between data, software and hardware.

Figure 2:
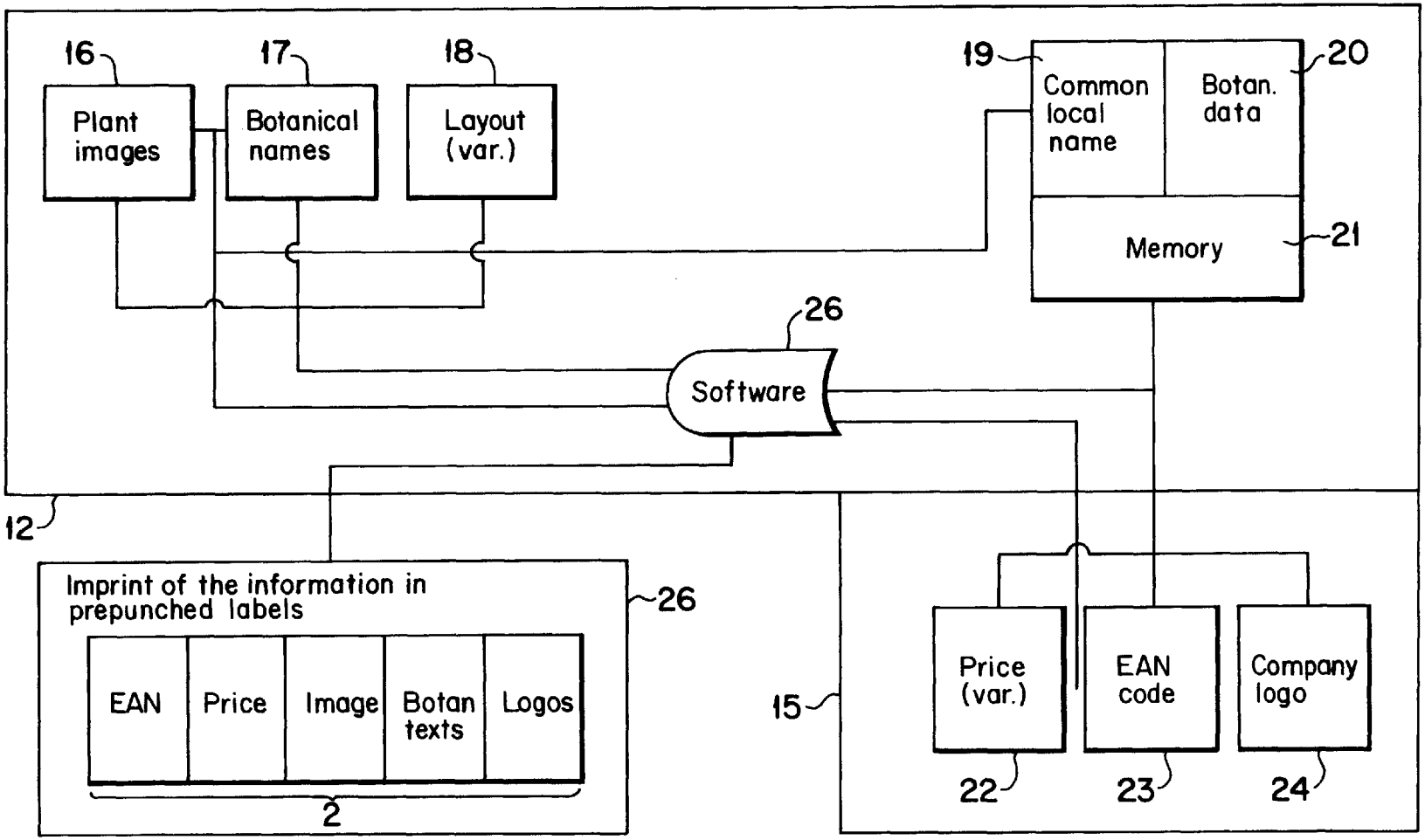
FIG. 2 shows a block diagram of a labelling system according to the invention.

FIG. 2 shows a block diagram of a labelling system according to the invention, which can be represented in a computer. The database of the labelling system according to the invention comprises an ROM area 12, the data of which can in principle be influenced only by the system manufacturer.

On the other hand, the data in the RAM area 15 can also be influenced by the user. The two database areas 12, 15 operate to a data output, which consists of a printer 26. According to the invention, all database areas are installed directly on the user's premises. Owing to the large quantity of data, it is preferable, according to the invention, to load at least the image data, but preferably all system manufacturer data and also the entire software for the labelling system, into a conventional computer by means of CD-ROM. The computer recommended is a 468/66 PC (or higher) with hard disk and CD-ROM drive. For the printer, it is advisable to use a standard colour laser printer with 600 dpi resolution. Colour laser printers for both A4 size and A3 size may be used.

Specifically, the ROM area 12 coordinated according to the invention with the computer comprises a data block 16 with data for 2500 to 40,000 images, a data block 17 with the corresponding 2500–40,000 Latin botanical names, which are stringently linked by the software with the associated image data, and a data block 18 with—optionally selectable—(variable) layouts for the label 2. Further fields are indicated by the dash-dot lines. In contrast to the known label, a printout could be obtained simply from this system area alone. As a rule, however, printouts are output in combination with the data of the second area. The ROM area 12 furthermore comprises a data block 19 with a selection of customary names for the corresponding plants, which may also be different names which however are stringently linked by means of software with the Latin botanical name, and a block 20 with the associated botanical data—which optionally may likewise be chosen from a variable selection—and a data memory 21, the object of which is to store the choice made by the user and thus to achieve ease of use for this user with the aid of the software, in that, when making an input the next time, the user need not each time again make the choice possible in the fields with possibilities of variations.

If required, the fixed data area may also be realized via an online link, for example to the manufacturer's database, so that the quantity and topicality of the available data are optimal.

The RAM area 15 which can be influenced by the user comprises a price data block and/or a symbol or colour data block 22 (depending on the user, it may be desired to provide only a specific colour imprint instead of price information or to include this colour imprint as a background to the price imprint), an EAN code block 23 and a block 24 with data relating to the company logo. If required, the user can optionally make a choice here too. This relates in particular to store chains with different individual locations. The blocks 15 on the one hand and 19, 20, 21 on the other hand operate jointly via the software with the blocks of the ROM area 25 on a printer driver which controls the printer 26. According to the invention, the completely printed label 2 or a completely printed label sheet 1 which need only be separated into the individual labels if the sheet 1 is prepunched, according to the surrounding lines of the labels, is obtained as a result of a single printing process.

Optionally, the software permits, in a separate program step, the changing—possibly with password protection—of the botanical master data (unless a selection from these data is in any case envisaged), in order to enable the user to adapt these data with respect to local circumstances.

The manufacturer provides the user with the database and the labels 2 supplied by the system manufacturer. In contrast to the known label, according to the invention the system manufacturer's labels 2 are completely blank. According to the invention, stock-keeping is thus limited to blank, preferably perforated and prepunched label sheets, which can be printed by the user according to his wishes even at the last minute. Stock-keeping is thus optimally reduced according to the invention.

Once a system has been installed and once a product name has been preselected, it is thus sufficient as a rule if the user merely inputs the desired product name or its Latin name and the desired price in the database. All other data fields are then automatically provided with the correct information under software control and the labels are printed on the blank sheets.

On the one hand, the system according to the invention offers improved security which prevents labels from being printed with incorrect or incompatible information. This ensures, inter alia, stringent compliance with the relevant price-marking provisions. If desired by the manufacturer and accepted, the needs of manufacturer and user can be chosen to be practically freely adaptable within the scope of the invention. Thus, for example, it is entirely possible to open or to close specific database areas with respect to the user for exerting an influence. It is also possible, for example in the case of users with relatively low sales, to leave the maintenance of the RAM block 15 to the manufacturer, so that the completely printed labels can be supplied to the user. In such a case too, it is preferable to install the complete hardware for the user and to enable him, by merely inputting his customary local name for the product, to print out the complete labels with all information. A further advantage to be singled out is that, if necessary, the labels required in each case can be completely printed out at the last minute, i.e. from the image to the optionally variable price, as already mentioned.

The previous necessity of storing label sheets preprinted with the colour images for each plant is completely dispensed with according to the invention.

Further inventive details are evident from the Figures themselves.

The label material according to the invention, which is protected or described in the Patent Claims, has the following advantages: it is economical, strong and absolutely weather-resistant and in particular can be printed in a smudge- and scratch-resistant manner by colour laser printers.

According to a further development which can also be used independently, at least a part of the loop label can be separated off along a prepunched perforation (27) after mounting of said label on the product, so that, according to the invention, the label can remain on the product and, for example, the EAN code or the like can nevertheless be read on a laser scanner cash register by the appropriate section being separated off manually and fed to the scanner.

What is claimed is:

1. Labelling system installable on a user's premises and comprising a product label having several fields, of which at least one is provided as a basic field (3) for holding basic information relating to the product to be labelled, at least one as a freely inscribable field (4) for holding variable information and at least one for holding an image which is directly related to the basic information a computer with a database having a first area (12) which in principle can be changed only by the system manufacturer or product manufacturer and in which product data relating to the product can be stored, and having a second area (15) which is also accessible to the user and in which specific user data relating to the product and the user can be stored, and with a printer (26) for the printing of labels (2) with the data mentioned an input unit for inputting the user data and controlling the computer and the printer (26), wherein the image data associated with software can also be stored in the first area (12) and wherein the software associates specific image data and a limited—optionally freely definable—selection of specific user data with the specific product data and makes it possible to print them out together on the printer, and wherein the label material or the material of the label sheet has the following specifications:

Color: initially colorless, white after laser-sensitizing coating

Thickness: 100 um

Surface resistance: $10^{12}$

Tensile Force:

Machine direction: MD 15.5 kg/mm$^2$

Diagonal: TD 17.5 kg/mm$^2$

Elongation at break:
MD 120%
TD 120%

Shrinkage:
MD 3%

(after 5 min at 190) TD 2%.

2. A method for printing labels which comprises printing the labels with a labelling system installable on a user's premises and comprising a product label having several fields, of which at least one is provided as a basic field (3) for holding basic information relating to the product to be labelled, at least one as a freely inscribable field (4) for holding variable information and at least one for holding an image which is directly related to the basic information a computer with a database having a first area (12) which in principle can be changed only by the system manufacturer or product manufacturer and in which product data relating to the product can be stored, and having a second area (15) which is also accessible to the user and in which specific user data relating to the product and the user can be stored, and with a printer (26) for the printing of labels (2) with the data mentioned an input unit for inputting the user data and controlling the computer and the printer (26), wherein the image data associated with software can also be stored in the first area (12) and wherein the software associates specific image data and a limited—optionally freely definable—selection of specific user data with the specific product data and makes it possible to print them out together on the printer, and wherein the label material or the material of the label sheet has the following specifications:

Color: initially colorless, white after laser-sensitizing coating

Thickness: 100 um

Surface resistance: $10^{12}$

Tensile Force:
Machine direction: MD 15.5 kg/mm$^2$
Diagonal: TD 17.5 kg/mm$^2$

Elongation at break:
MD 120%
TD 120%

Shrinkage:
MD 3%

(after 5 min at 190) TD 2%.

* * * * *